US006645010B1

(12) United States Patent
Billman et al.

(10) Patent No.: US 6,645,010 B1
(45) Date of Patent: Nov. 11, 2003

(54) HIGH DENSITY ELECTRICAL CONNECTOR WITH IMPROVED GROUNDING BUS

(75) Inventors: Timothy B. Billman, Dover, PA (US); Iosif R. Korsunsky, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/165,559

(22) Filed: Jun. 7, 2002

(51) Int. Cl.[7] ..... H01R 13/648
(52) U.S. Cl. ..... 439/608; 439/108
(58) Field of Search ..... 439/608, 108, 439/101, 701

(56) References Cited

U.S. PATENT DOCUMENTS 5,980,321 A * 11/1999 Cohen et al. ..... 439/608
6,083,047 A * 7/2000 Paagman ..... 439/608
6,152,747 A * 11/2000 McNamara ..... 439/108
6,171,115 B1 1/2001 Mickievicz et al.
6,174,202 B1 1/2001 Mitra
6,267,604 B1 * 7/2001 Mickievicz et al. ..... 439/79
6,299,484 B2 * 10/2001 Van Woensel ..... 439/608
6,375,508 B1 * 4/2002 Pickles et al. ..... 439/608
6,390,857 B1 * 5/2002 Pickles et al. ..... 439/701

* cited by examiner

*Primary Examiner*—Gary Paumen
(74) *Attorney, Agent, or Firm*—Wei Te Chung

(57) ABSTRACT

An electrical connector (1) comprises a dielectric frame (10) defining a receiving cavity (12), a plurality of printed circuit substrates (30), and a spacer (20) assembled with the printed circuit substrates. The spacer includes a plurality of wafers (21) and defines a plurality of tunnels (22) between every two adjacent wafers for receiving corresponding printed circuit substrates. Each wafer has a dielectric body (23), a plurality of terminals (25) for conductively contacting signal traces of the printed circuit substrate, and a grounding bus (24) covering on the dielectric body. Each grounding bus forms at least one resilient arm (28) conductively contacting with grounding traces on the printed circuit substrate before the signal terminals conductively contact the signal traces on the printed circuit substrate.

1 Claim, 9 Drawing Sheets

HIGH DENSITY ELECTRICAL CONNECTOR WITH IMPROVED GROUNDING BUS

CROSS-REFERENCE TO RELATED APPLICATIONS

This application is a co-pending application of Patent Application with unknown serial number filed on Jun. 4, 2002, entitled "HIGH DENSITY ELECTRICAL CONNECTOR WITH LEAD-IN DEVICE", and a patent application Ser. No. 10/162,724 filed on May 22, 2002, entitled "HIGH DENSITY ELECTRICAL CONNECTOR", both invented by the same inventors, assigned to the same assignee and filed on the same date as the present application. The disclosures of the applications are wholly incorporated herein by reference.

BACKGROUND OF THE INVENTION

1. Field of the Invention

The present invention relates to an electrical connector, and particularly to a high density electrical connector having an improved grounding bus.

2. Description of Related Art

With the development of communication and computer technology, high-density electrical connectors with conductive elements in a matrix arrangement are desired to construct a large number of signal transmitting paths between two electronic elements. The high-density electrical connectors are widely used in internal connecting systems of severs, routers and the other like devices requiring high-speed data processing and communication. Such high-density electrical connectors are disclosed in U.S. Pat. Nos. 6,152,747, 6,267,604, 6,171,115, 5,980,321, and 6,299,484. These high-density connectors generally comprise two mating connector halves, i.e., a plug connector half connecting with a backplane and a receptacle connector half connecting with a daughter card and for mating with the plug connector half,.thereby establishing an electrical circuitry between the daughter card and the backplane.

As disclosed in U.S. Pat. Nos. 6,174,202 and 6,171,115, the electrical connectors thereof each include a grounding plate which functions as an Electromagnetic Interference (EMI) shielding to prevent signal terminals of the electrical connector from cross talking, thereby improving stability and reliability of signal transmission of the connector. As well known, electrostatic charges on the connector also adversely affects the stability or reliability of the signal transmission of the connector. However, the prior art does not provide means on the grounding plate which can effectively dissipate the electrostatic charges on the connector through the grounding plate; thus, the problem of an unreliable signal transmission still exists and needs to be resolved.

Hence, a high-density electrical connector with an improved grounding bus is desired to overcome the disadvantages of the prior art.

SUMMARY OF THE INVENTION

Accordingly, a first object of the present invention is to provide a high density electrical connector having an improved grounding bus for ensuring reliability and stability of signal transmission.

A second object of the present invention is to provide a high density electrical connector having a plurality of printed circuit substrates therein for electrically connecting two electronic components together.

T o fulfill the above objects, an electrical connector, to be mounted on a mother board, in accordance with the present invention comprises a dielectric frame defining a receiving cavity, a plurality of printed circuit substrates, and a spacer assembled with the printed circuit substrates. The spacer includes a plurality of wafers and defines a plurality of tunnels between every two adjacent wafers for receiving corresponding printed circuit substrates. Each wafer has a dielectric body, a plurality of signal terminals for conductively contacting signal traces of the printed circuit substrate, and a grounding bus covering on the dielectric body. Each grounding bus forms at least one resilient arms conductively contacting with grounding traces formed on the printed circuit substrate before the signal terminals conductively contact the signal traces formed on the printed circuit substrate for removing static remained on the grounding bus.

Other objects, advantages and novel features of the invention will become more apparent from the following detailed description when taken in conjunction with the accompanying drawings.

DETAILED DESCRIPTION OF THE INVENTION

Figure 1:
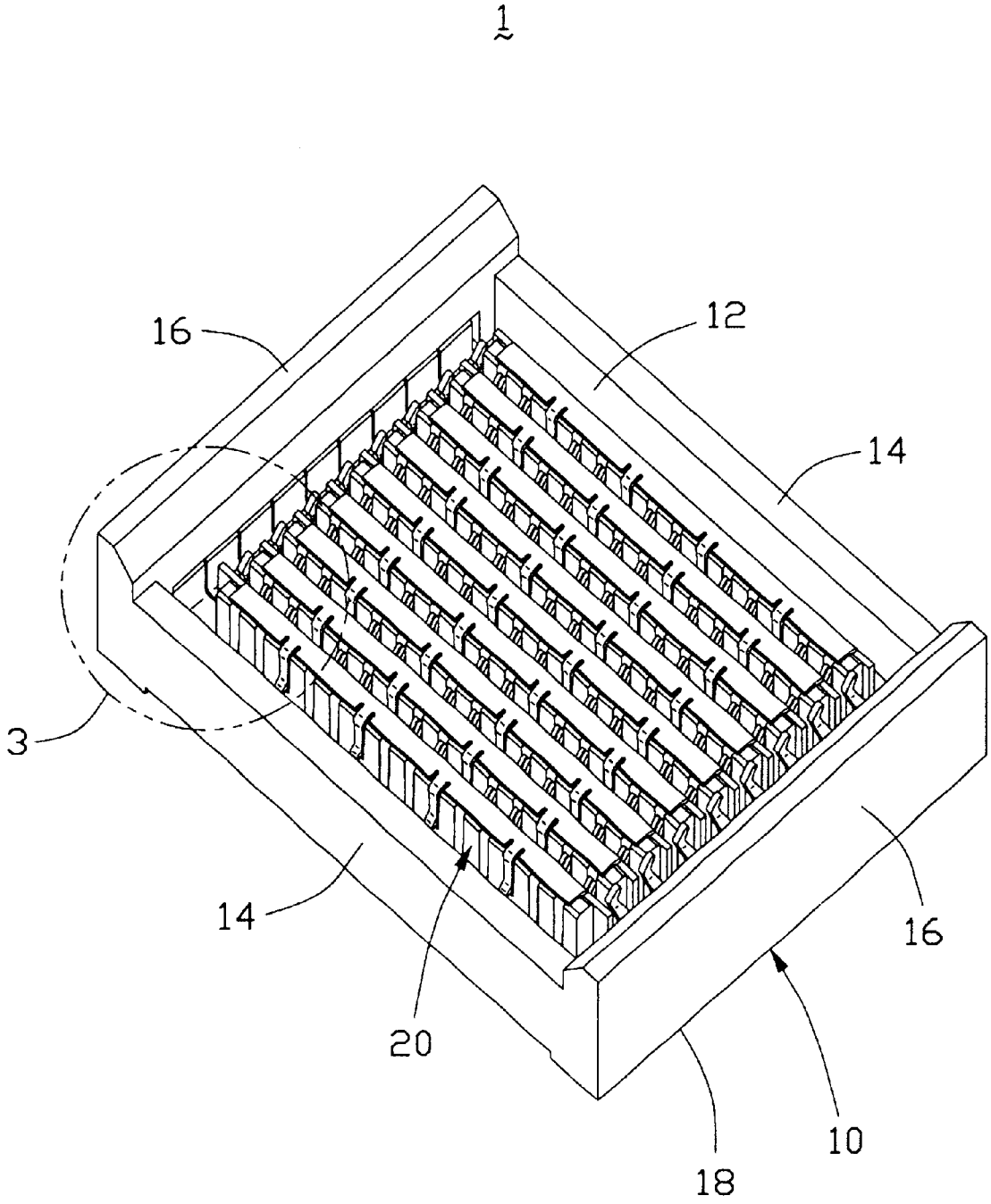
FIG. 1 is a perspective view of an electrical connector in accordance with the present invention.
Figure 2:
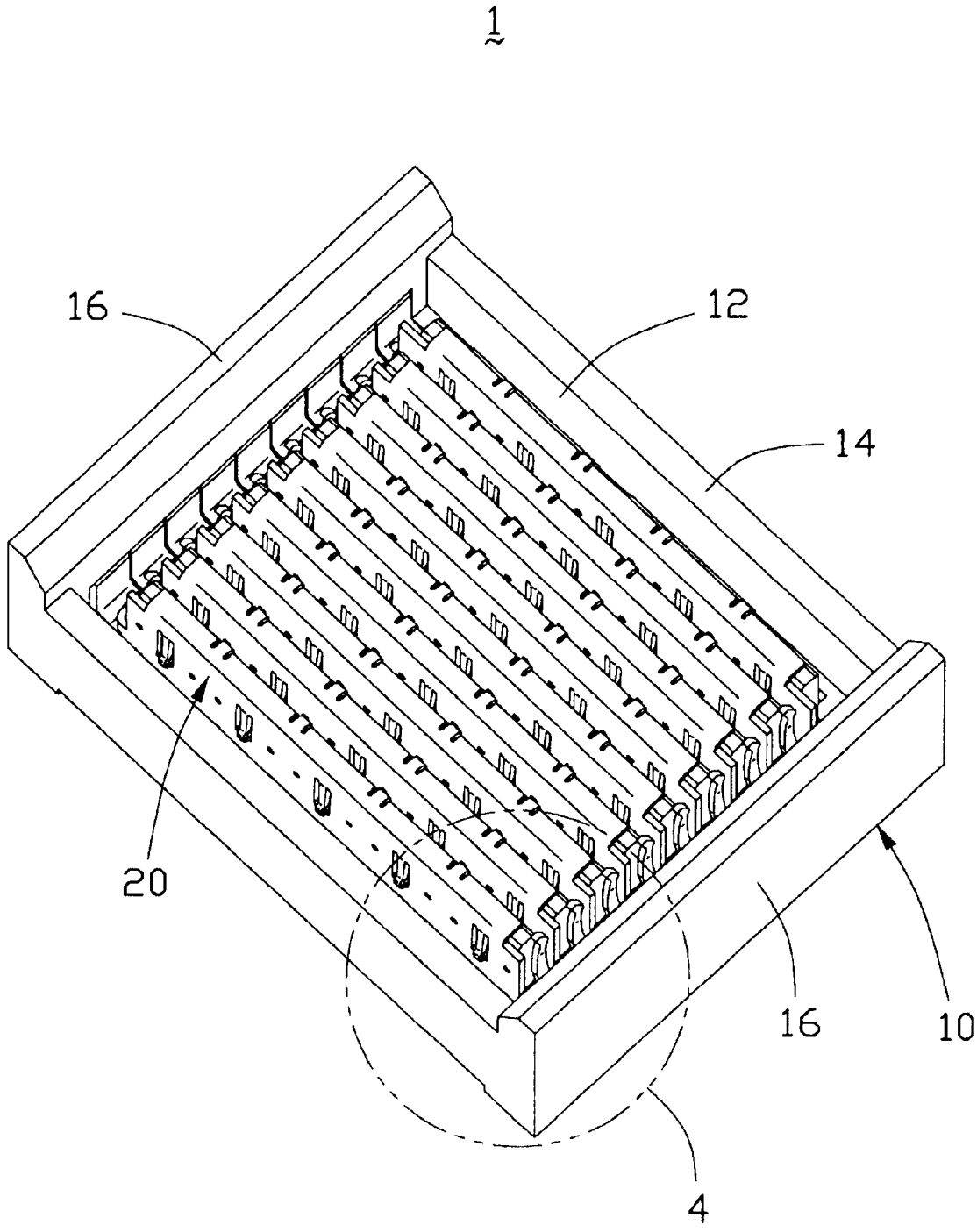
FIG. 2 is another perspective view of the electrical connector of FIG. 1.
Figure 3:
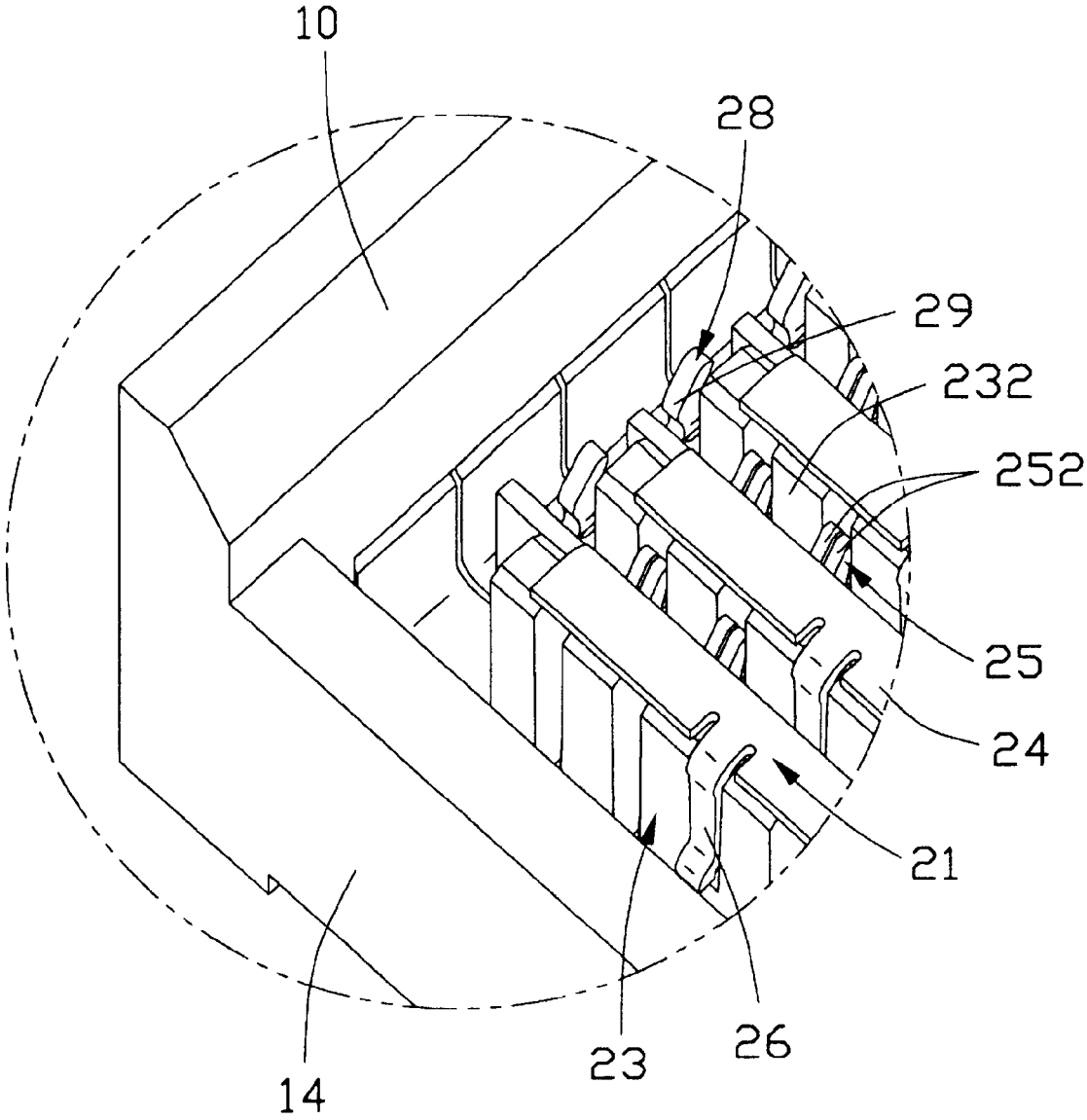
FIG. 3 is a partially enlarged view of FIG. 1.
Figure 4:
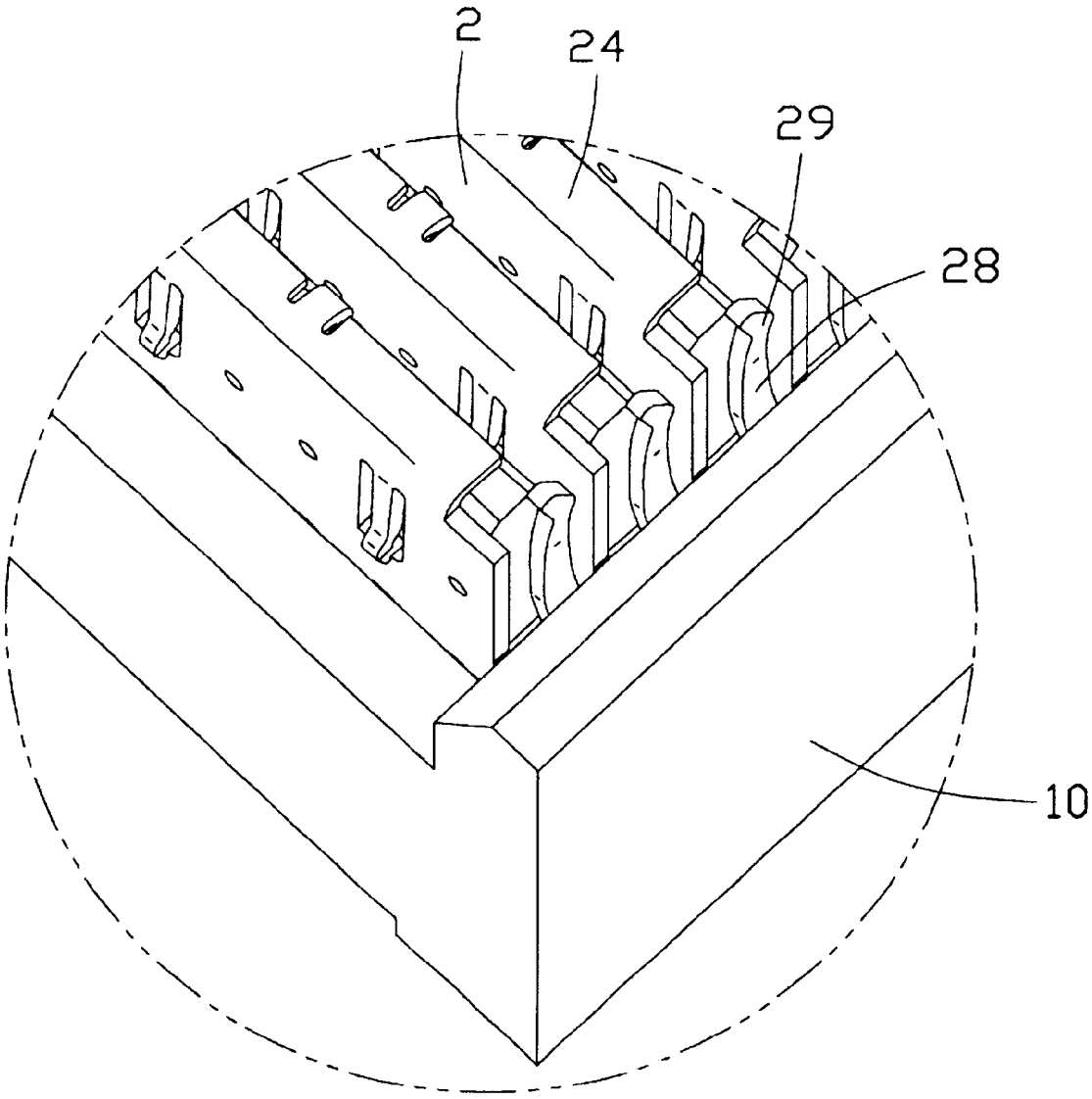
FIG. 4 is a partially enlarged view of FIG. 2.
Figure 5:
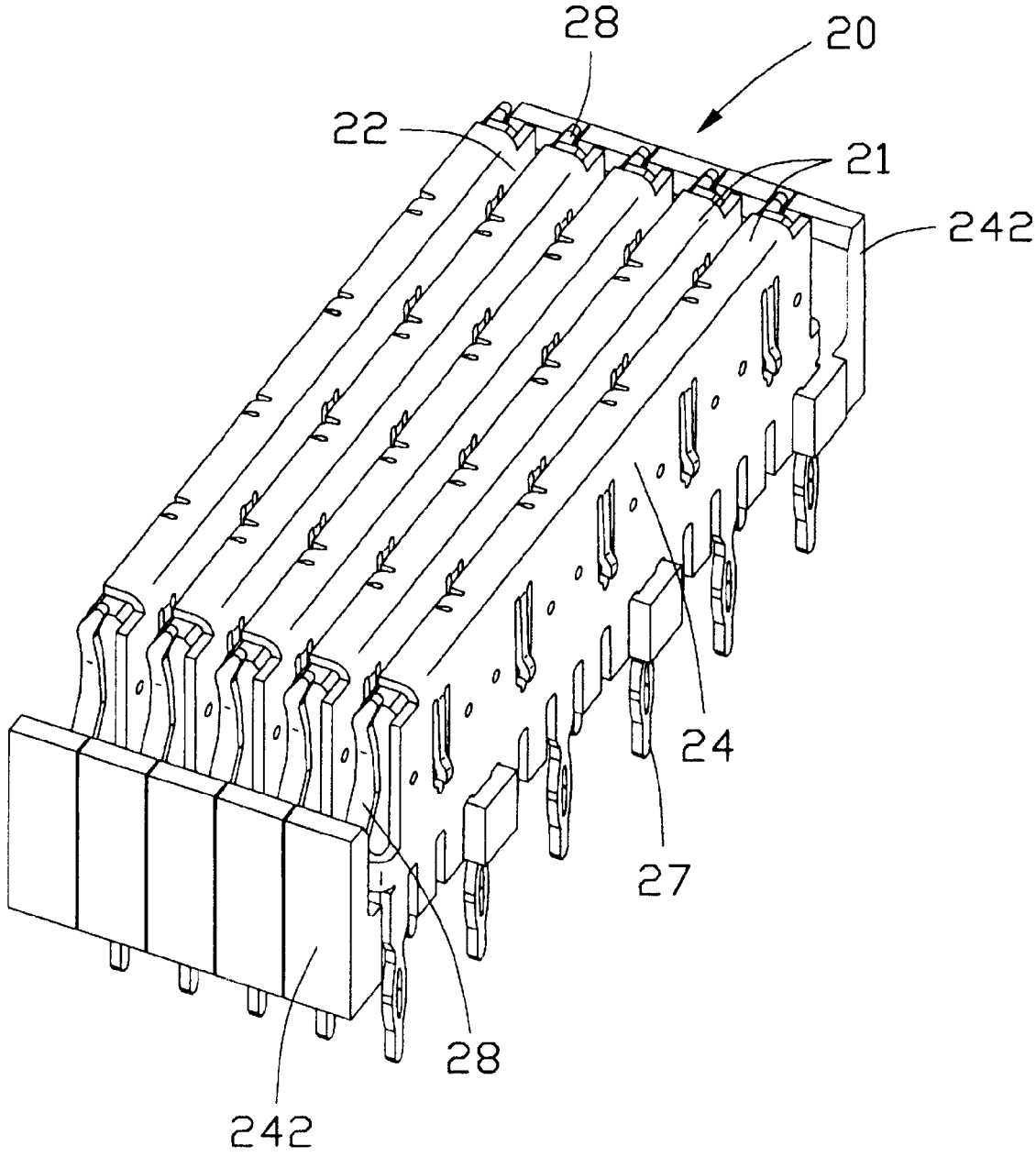
FIG. 5 is a perspective view of a spacer of the electrical connector of FIG. 1.
Figure 6:
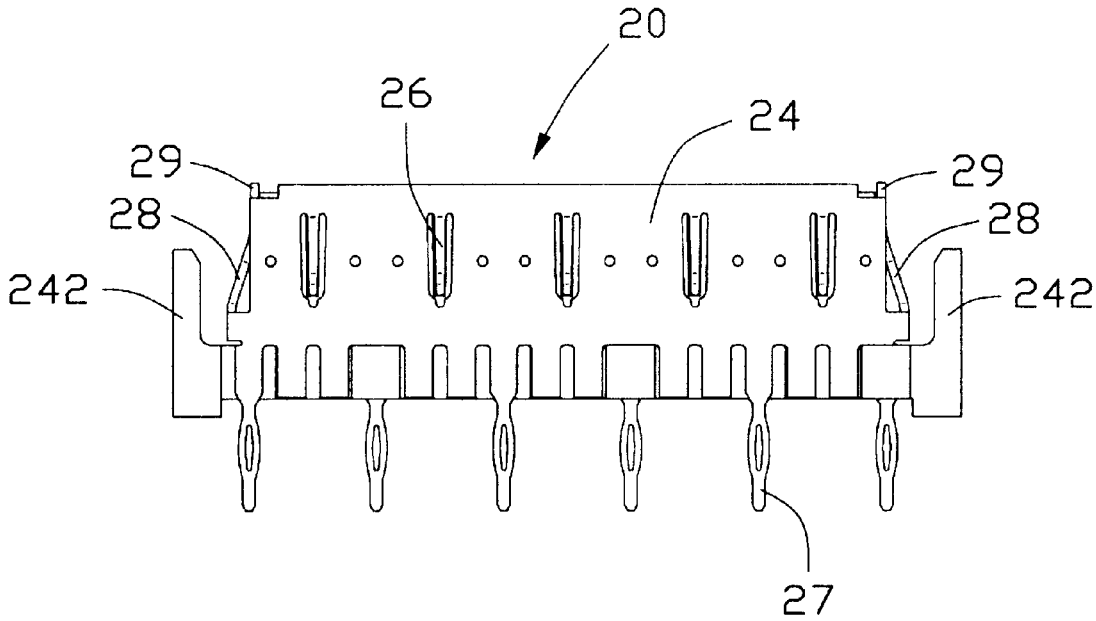
FIG. 6 is a front view of FIG. 5.
Figure 7:
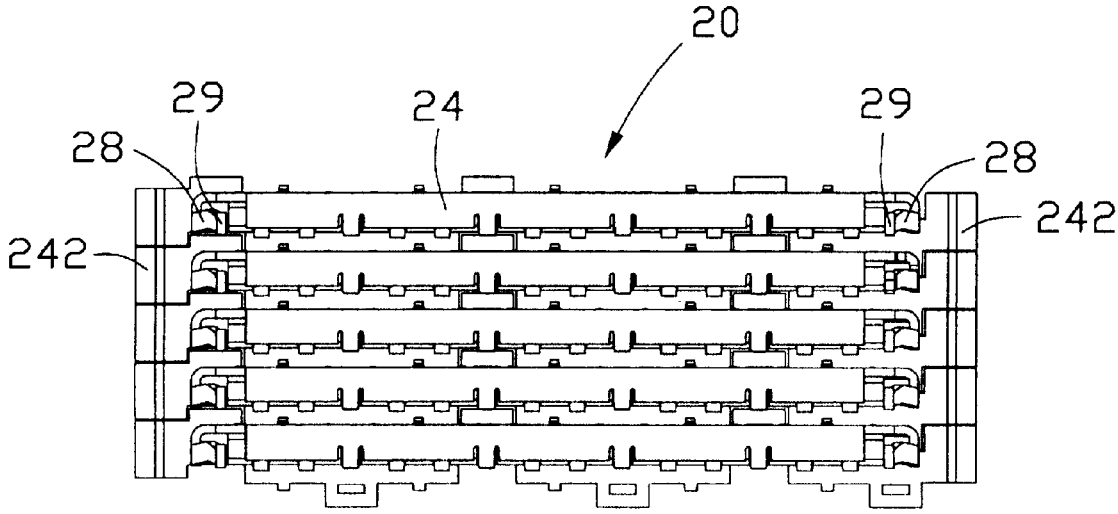
FIG. 7 is a top view of FIG. 5.
Figure 8:
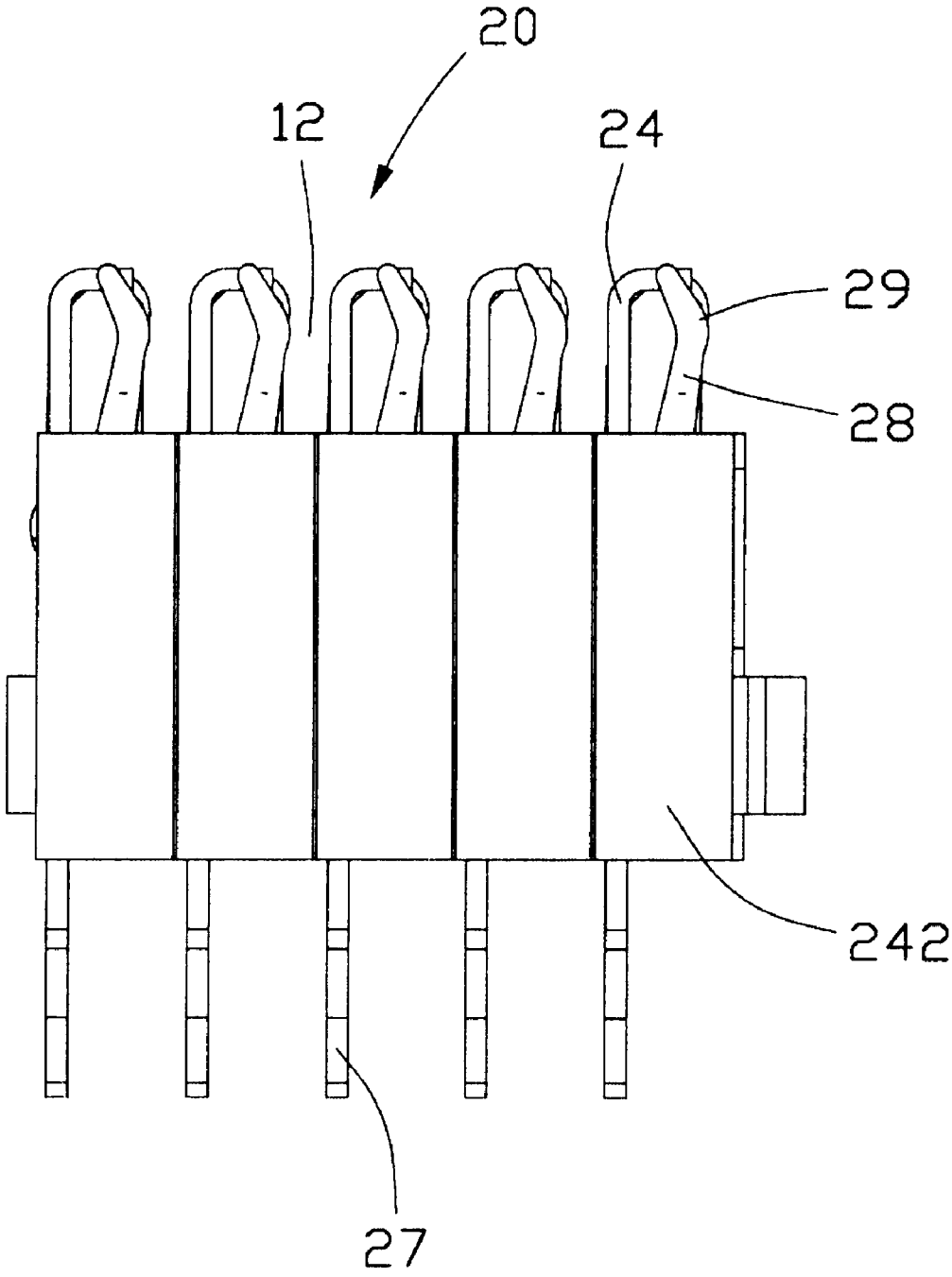
FIG. 8 is a side view of FIG. 5.
Figure 9:
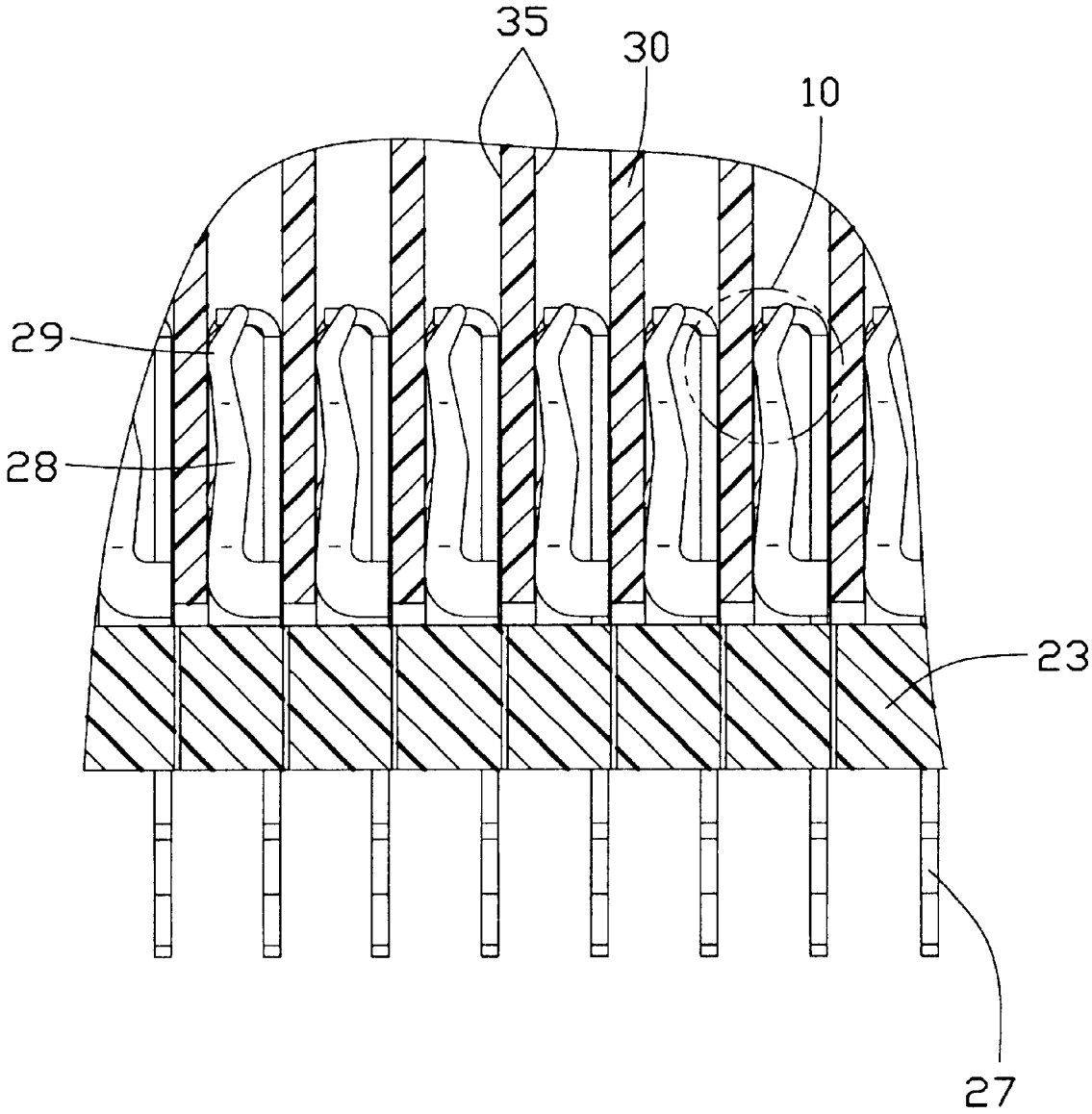
FIG. 9 is a cross-sectional view taken along line 9—9 of FIG. 7 with a plurality of printed circuit substrates of a complementary electrical connector inserted into the spacer.

Referring to FIGS. 1–2, an electrical connector 1 in accordance with a preferred embodiment of the present invention is for mounting to a circuit board (not shown) and comprises a dielectric frame 10 defining a cavity 12, a spacer 20 inserted into the cavity 12 and a plurality of printed circuit substrates 30 (see FIG. 9) inserted in the spacer 20. Each printed circuit substrate 30 includes a dielectric substrate 31 made of conventional circuit board substrate material, such as FR4, and a plurality of conductive signal and grounding traces (not labeled) formed on opposite side surfaces 35 thereof.

The dielectric frame 10 is rectangular in shape and has a pair of side walls 14, a pair of end walls 16 and a bottom wall 18 which cooperatively define the cavity 12 for accommodating the spacer 20.

Referring to FIGS. 3 to 8, the spacer 20 has a structure which is similar to that of the spacer disclosed in each of the co-pending applications set forth in CROSS-REFERENCE TO RELATED APPLICATIONS. Thus, detailed description of the spacer 20 is omitted herewith and only the inventive feature formed on the spacer 20 in accordance with the preferred embodiment of the present invention is detailedly described below. The spacer 20 consists of a plurality of wafers 21 side by side arranged and defines a plurality of tunnels 22 between every two adjacent wafers 21. Each tunnel 22 has a predetermined width for receiving a corresponding printed circuit substrate 30 of a complementary electrical connector (not shown) when the complementary connector mates with the electrical connector 1. Each wafer 21 has an elongated dielectric body 23, a plurality of signal terminals 25 integrally insert molded in the dielectric body 23, and a grounding bus 24 covering on the dielectric body 23. Each signal terminal 25 forms a contact point 252 extending out of one side face 232 of the dielectric body 23 into an adjacent tunnel 22 for conductively contacting corresponding signal traces (not shown) formed on an inserted printed circuit substrate 30. The wafer 21 further forms a pair of end portions 242 extending upward from opposite ends thereof to be interferingly retained into the cavity 12. The grounding bus 24 substantially covers the other side surface (not labeled) of the dielectric body 23 opposite to the one side surface 232 for providing EMI shielding for the adjacent signal terminals 25. The grounding bus 24 forms a plurality of grounding ribs 26 for conductively contacting corresponding grounding traces (not shown) formed on the inserted printed circuit substrate 30 and a plurality grounding tails 27 extending downward from a bottom edge thereof for insertion into the circuit board to electrically connecting with a grounding trace of the circuit board.

Figure 10:
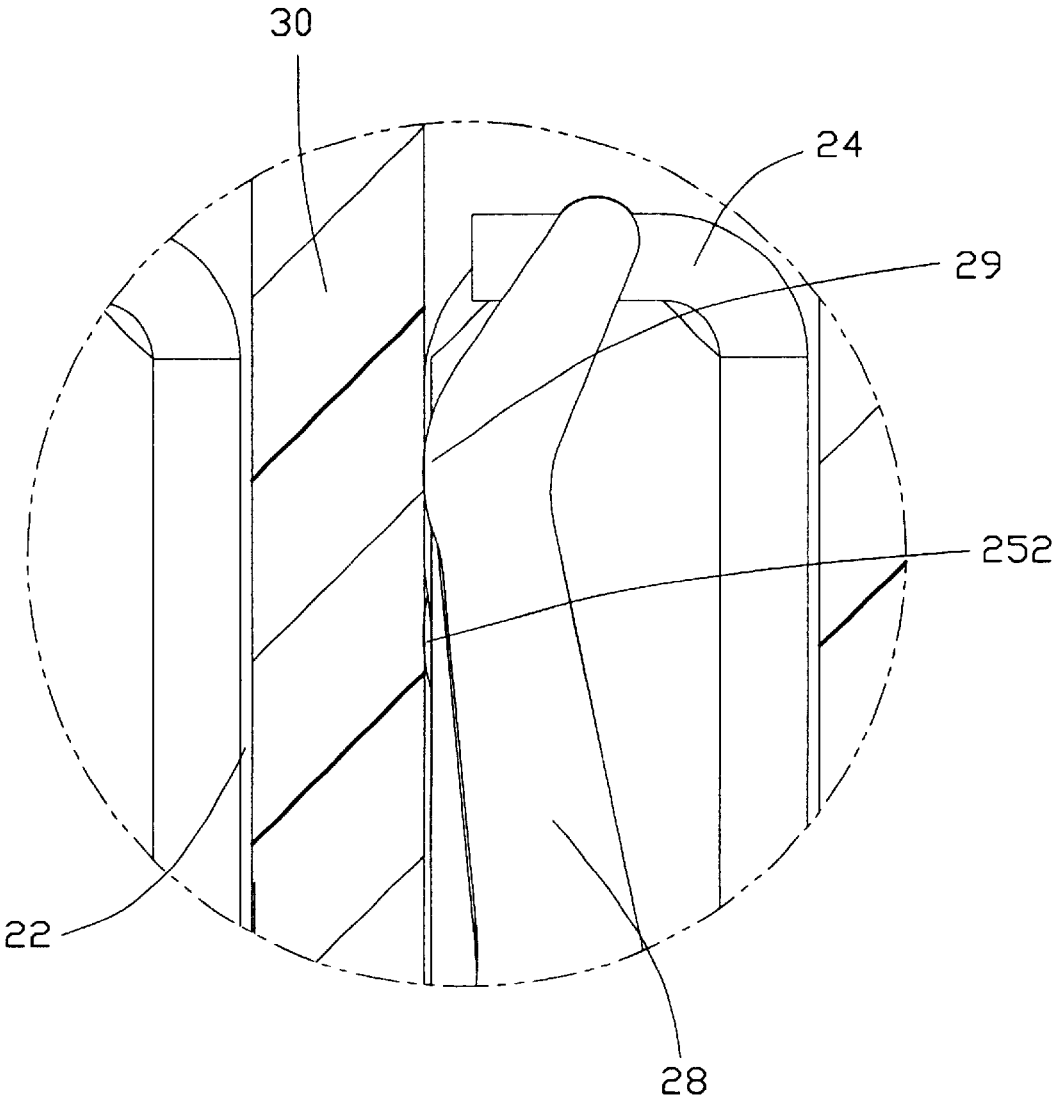
FIG. 10 is an enlarged view of a portion of FIG. 9, indicated by a reference number 10.

Additionally, a pair of resilient arms 28 extends upward from opposite sides of the each grounding bus 24 and is convergent toward a middle portion of the wafer 21. Each resilient arm 28 forms an arc free end 29 extending out of the side surface 232 of the dielectric body 23 into a corresponding tunnel 22 for conductively contacting a corresponding grounding trace of the inserted printed circuit substrate 30. It is noted that the arc free ends 29 are located higher than the contact points 252 of the signal terminals 25 (see FIG. 10), and accordingly, the free ends 29 will firstly conductively contact the grounding traces of the inserted printed circuit substrates 30 before the contact points 252 conductively contact corresponding signal traces of the inserted printed circuit substrates 30 during insertion of the printed circuit substrates 30 into the tunnels 22 when the electrical connector 1 mates with the complementary electrical connector. Therefore, electrostatic charges on the electrical connector 1 can be effectively dissipated to ground by the engagement between the grounding traces of the printed circuit substrates 30 and the free ends 29 of the resilient arms 28, prior to signal transmission between the two electrical connectors. Accordingly, the stability and reliability of the signal transmission by the signal terminals 25 of the electrical connector 1 of the present invention is ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric frame defining a receiving cavity; and a spacer received in the receiving cavity, the spacer including a plurality of wafers defining a plurality of tunnels between every two adjacent wafers for accommodating printed circuit substrates therein, each wafer having a dielectric body, a plurality of signal terminals retained in the dielectric body, each signal terminal forming a contact point for conductively contacting a signal trace formed on a corresponding printed circuit substrate, and a grounding bus covering the dielectric body and having at least one resilient arm having an arc free end for conductively contacting with a grounding trace formed on the corresponding printed circuit substrate;

wherein the arc free end of the at least one resilient arm is located higher than the contact point of each signal terminal so that the at least resilient arm conductively contact with the grounding trace before the signal terminals conductively contact with the signal traces of the corresponding printed circuit substrate;

wherein the grounding bus has a body plate covering a side surface of the dielectric body of each wafer;

wherein the grounding bus has a pair of resilient arms extending upwardly and convergently from opposite sides of the body plate of the grounding bus;

wherein each resilient arm forms an arc free end extending out of another side surface opposite to the side surface of the dielectric body for conductively contacting the grounding trace of the corresponding printed circuit substrate;

wherein the arc free ends of the resilient arms are located higher than the contact points of the signal terminals and thus adapted to firstly conductively contact the grounding trace of the corresponding printed circuit substrate before the contact points of the signal terminals are adapted to conductively contact the signal trace of the corresponding printed circuit substrate;

wherein the body plate of the grounding bus further forms a plurality of resilient ribs for electrically connecting with the corresponding printed circuit substrate and a plurality of grounding tails for insertion into a circuit board.

* * * * *